US006017014A

United States Patent [19]

Maguire

[11] Patent Number: 6,017,014

[45] **Date of Patent: *Jan. 25, 2000**

[54] HOLDER FOR VERTICAL STEEL REBAR

[76] Inventor: Joe Maguire, 1865 261st St., Lomita, Calif. 90717-3306

[ * ] Notice: This patent is subject to a terminal disclaimer.

[21] Appl. No.: 09/028,104

[22] Filed: Feb. 23, 1998

[51] Int. Cl.[7] ..... E04G 17/00

[52] U.S. Cl. ..... 249/91; 249/93; 249/211; 249/219.1; 52/677; 52/699

[58] Field of Search ..... 52/677, 686, 699, 52/704, 719, 105; 248/74.2, 214, 316.7; 249/91, 93, 177, 219.1, 211; 264/35

[56] References Cited

U.S. PATENT DOCUMENTS

| | | | |
|---|---|---|---|
| 2,523,785 | 9/1950 | Sereno | 248/316.7 |
| 3,530,634 | 9/1970 | Adams . | |
| 4,042,198 | 8/1977 | Takeuchi | 248/74.2 |
| 4,610,122 | 9/1986 | DeClercq | 52/686 |
| 4,803,825 | 2/1989 | Wheeler | 52/677 |
| 5,337,534 | 8/1994 | Nasca | 52/699 X |
| 5,371,991 | 12/1994 | Bechtel et al. | 52/686 |
| 5,388,804 | 2/1995 | Cohen et al. | 52/699 X |
| 5,688,428 | 11/1997 | Maguire | 52/677 X |

FOREIGN PATENT DOCUMENTS

| | | | |
|---|---|---|---|
| 1224183 | 9/1960 | France | 52/677 |
| 2439350 | 5/1980 | France | 248/74.2 |

*Primary Examiner*—Robert Canfield
*Attorney, Agent, or Firm*—Irving Keschner

[57] ABSTRACT

A member having first and second vertically extending leg portions, and a base member connecting one end of each leg member, a wood beam for the concrete structure being positioned in the channel formed between the first and second leg portions. A cup shaped member is formed along the outside surface of the first leg portion, a vertical steel rebar or anchor bolt, being positioned in the cup shaped member. Holes may be formed in the base member to receive fasteners to secure the member to the underlying wood frame member. Protrusions are provided on the bottom surface of the base member thus providing a space between the surface and adjacent top surface of said wood frame member to enable the device to be removed after the concrete sets.

7 Claims, 1 Drawing Sheet

HOLDER FOR VERTICAL STEEL REBAR

BACKGROUND OF THE INVENTION

1. Field of the Invention

The present invention provides a device for supporting vertical steel rebar of various diameters during the pouring of a concrete structure.

2. Description of the Prior Art

In typical construction projects which require concrete structures, such as foundations, vertical extending steel rebar is necessary to strengthen the structure.

In order to hold the rebar in position during the pouring of the concrete, the prior art typically utilized steel tie wires connecting the rebar to an underlying wood frame member. In essence, the tie wire is coupled to the rebar at one end and the wood frame at the other. After the concrete sets, the wood frame is removed from the adjacent concrete structure. Although the use of tie wires provides a simple technique for positioning the rebar, it requires a person to hold the rebar during the tying operation. In addition, the rebar often does not maintain a proper vertical orientation during the concrete pouring stage. Finally, wire cutters are needed to cut the tie wire in order to remove the wood frame after the concrete sets.

An improved vertical rebar positioning device is a hook and clamp type device manufactured by Precision Builders, Redding, Calif. The hook portion of this device fits about the rebar, the clamp portion being secured to the wood frame. Although providing advantages over the commonly used tie wires, it has a serious disadvantages in that it is costly and difficult to remove the wood frame member after the concrete sets.

U. S. Pat. No. 5,688,428 issued on Nov. 18, 1997 to the applicant, an improved device for positioning vertical steel rebar which is less expensive than those available in the prior art and wherein the installation time required for the vertical steel rebar is reduced, thus reducing labor costs is disclosed. Although the holder disclosed in the '428 patent has found wide commercial acceptance, the holder has a plurality of different sized holders for holding steel rebar of various external diameters. There are situations however wherein purchasers may desire to purchase a device holder which has a single holder to reduce the overall costs of the steel rebar device disclosed in the →428 patent.

SUMMARY OF THE PRESENT INVENTION

The present invention provides a member having first and second vertically extending leg portions, and a base member connecting one end of each leg member, a wood frame member for the concrete structure being positioned in the channel formed between the first and second leg portions. A single cup shaped member is formed along the outside surface of one of the leg portions, a vertical steel rebar being positioned in the cup shaped member. Holes may be formed in the base member to receive fasteners to secure the member to the underlying wood frame member. Protrusions are provided on the bottom surface of the base member to provide a space between the surface and the adjacent top surface of the wood frame member to enable the device to be removed after the concrete sets.

The present invention thus provides a relatively inexpensive vertical steel rebar placement device which has the capability of supporting rebar of a specified diameter and wherein the device can be easily removed after the concrete is poured and sets.

BRIEF DESCRIPTION OF THE DRAWING

For a better understanding of the invention, as well as other objects and further features thereof, reference is made to the following description which is to be read in conjunction with the accompanying drawing wherein.

DESCRIPTION OF THE INVENTION

Figure 1:
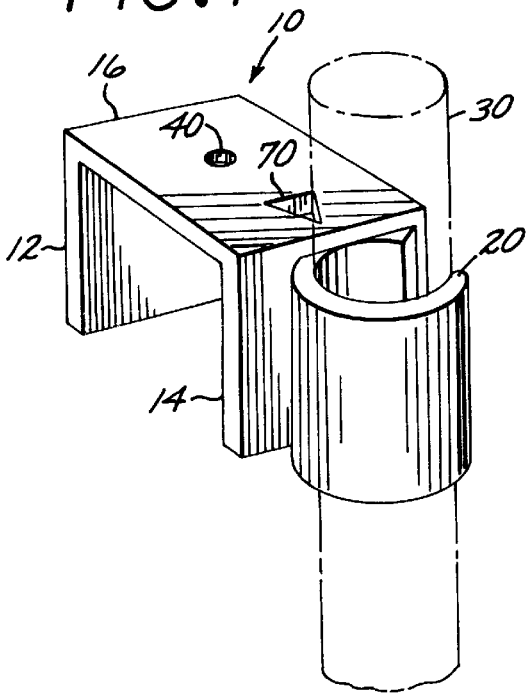
FIG. 1 is a perspective view of the device of the present invention.
Figure 2:
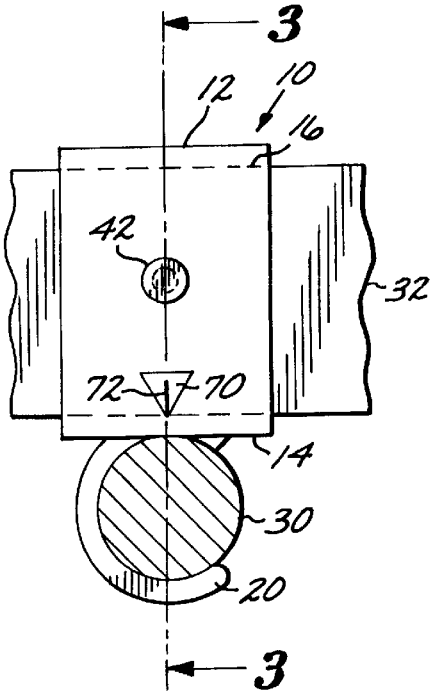
FIG. 2 is a top plan view of the device shown in FIG. 1.
Figure 3:
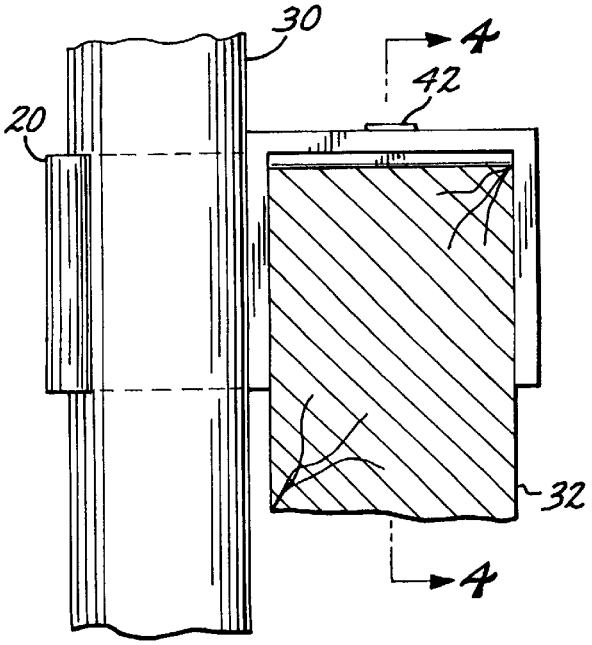
FIG. 3 is a cross-sectional view along line 3—3 of FIG. 2.
Figure 4:
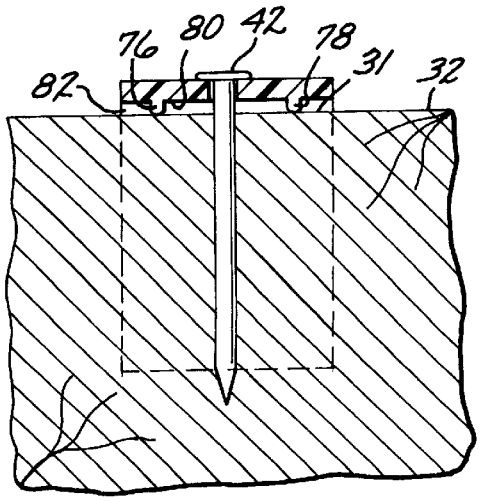
FIG. 4 is a cross-sectional view along line 4—4 of FIG. 3.

Referring now to FIGS. 1–4, a vertical steel rebar holding device 10 of the present invention is illustrated. Device 10, preferably made of plastic, comprises a U-shaped member having leg portions 12 and 14 joined by base member 16 and a single cup shaped member 20 integral with the outside surface of wall 14 as illustrated. The cupped shaped member 20 is essentially cylindrical in shape and has an extended longitudinal opening, or, slot formed along the entire length thereof as illustrated. The internal diameter of the shaped member is of a predetermined size and selected to correspond to the outside diameter of steel rebar having a specific diameter. In the example illustrated, cup shaped member 20 has an internal diameter of approximately 0.5 inches and is sized to frictionally engage the vertical steel rebar 30 and hold the rebar in place during the concrete pouring operation. It should be noted that although the rebar is the preferred structural member to be inserted into member 20, an anchor bolt can also be utilized if necessary. In this case, member 20 effectively provides a damping force on the anchor bolt. The length of device 10, along its longitudinal dimension, is variable, typically in range from about 4 inches to about 6 inches and is selected to enable the steel rebar to be utilized for a particular project. A hole, or aperture, 40 is formed in base member 16 and a fastener, such as a nail, 42 is positioned therethrough as illustrated in FIG. 4 to secure device 10 to frame member 32.

In operation, after the wood framing is constructed, device 10 is positioned over the top edge thereof in the manner shown in FIGS. 2–4. Fastener 42 is then inserted through hole 40 into the surface 31 of frame member 32. Steel rebar is then positioned into member 20 and thereafter the concrete is poured. It should be noted that the height of device 10 is selected, in conjunction with the height of wood frame member 32, so that the level of the concrete is below the bottom surface of the cup shaped member. In essence, the device 10 is not embedded in the concrete after the concrete sets. After the concrete sets, device 10 is removed from frame member 34 by first removing fastener 42 and then using the claw portion of a hammer to remove device 10 and then hitting the side of wooden member 32 so that the wooden member slides free from the adjacent set concrete. Alternatively, device 10 can be hit in the direction facing the open portion of cup member 20, thus causing the device to slide off frame member 32.

A triangular shaped see-through aperture 70 is formed in base portion 16 enabling a user to look for a marking 72 (FIG. 2) formed in the upper surface of wood frame member 32 and accurately position device 10. A pair of protrusions 76 and 78 are formed in the lower surface 80 of base member 16 to provide a space 82 between surface 80 and the adjacent surface of frame member 32.

Device 10 is preferably made of plastic and molded in a manner such that base member 16, leg portions 12 and 14, holder member 20 and protrusions 76 and 78 are integral.

A plurality of devices 10 are typically utilized in a construction project.

The present invention thus provides a device for accurately positioning vertical rebar used in conjunction with concrete construction which is relatively inexpensive and wherein the wood frame member is easily removed after the concrete sets.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A system for use during the pouring of concrete into an area framed by a wooden frame member, comprising a frame member having an edge portion extending in a first direction, an elongated member;

a U-shaped member comprising first and second elongated leg portions and a base member joining said first and second portions, a channel area being formed between said joined leg portions, the edge portion of said frame member being positioned within said channel, said first and second leg portions having exterior surfaces; and a single cylindrical shaped holding member having a slot formed along the longitudinal length thereof extending from the exterior surface of said first leg portion, said holding member frictionally engaging and holding said elongated member of a predetermined outside diameter inserted therein in the substantially vertical direction.

2. The system of claim 1 wherein said elongated member comprises rebar.

3. The system of claim 1 wherein said elongated member comprises an anchor bolt.

4. The system of claim 1 wherein at least one protrusion extends from the bottom surface of said base member whereby a space is provided between said bottom surface and the top surface of said frame member.

5. The system of claim 1 wherein at least one fastener receiving aperture is formed in said base member.

6. The system of claim 1 wherein at least one aperture is formed in said base member to enable a user to view markings formed on the top surface of said frame member.

7. The system of claim 1 wherein said holding member is integral with the surface of said first leg portion.

* * * * *